US012129754B2

(12) United States Patent
Murugesan et al.

(10) Patent No.: US 12,129,754 B2
(45) Date of Patent: Oct. 29, 2024

(54) TRACER-EMBEDDED DEGRADABLE ARTICLES, METHOD OF MANUFACTURE, AND USE THEREOF FOR DOWNHOLE APPLICATIONS

(71) Applicant: Baker Hughes Oilfield Operations LLC, Houston, TX (US)

(72) Inventors: Sankaran Murugesan, Katy, TX (US); Radhika Suresh, Sugar Land, TX (US); Todd C. Jackson, Houston, TX (US); Anil Sadana, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/177,919

(22) Filed: Mar. 3, 2023

(65) Prior Publication Data

US 2023/0279771 A1 Sep. 7, 2023

Related U.S. Application Data

(60) Provisional application No. 63/316,126, filed on Mar. 3, 2022.

(51) Int. Cl.
*E21B 47/11* (2012.01)
*E21B 49/08* (2006.01)

(52) U.S. Cl.
CPC ..... *E21B 47/11* (2020.05); *E21B 49/088* (2013.01)

(58) Field of Classification Search
None
See application file for complete search history.

(56) References Cited

U.S. PATENT DOCUMENTS

| | | | | |
|---|---|---|---|---|
| 10,502,040 | B1 | 12/2019 | Murugsan et al. | |
| 2016/0209391 | A1 | 7/2016 | Zhang et al. | |
| 2018/0087369 | A1* | 3/2018 | Sherman | E21B 47/11 |
| 2019/0016950 | A1 | 1/2019 | Cannan et al. | |
| 2019/0055810 | A1* | 2/2019 | Fripp | A61K 47/34 |

(Continued)

FOREIGN PATENT DOCUMENTS

| | | | |
|---|---|---|---|
| WO | 2017116407 | A1 | 7/2017 |
| WO | 2021176192 | A1 | 9/2021 |

OTHER PUBLICATIONS

Murugesan et al., "Upconversion Nanoparticles as Tracers for Production and Well Monitoring"; Society of Petroleum Engineers SPE-191659-MS; Sep. 24, 2018; 10 pages.

(Continued)

*Primary Examiner* — Andrew Sue-Ako
(74) *Attorney, Agent, or Firm* — CANTOR COLBURN LLP

(57) ABSTRACT

A tracer-embedded degradable article includes: a degradable metallic carrier; and a tracer disposed in the degradable metallic carrier, wherein the tracer includes an upconverting particle that has a host material, and a dopant. The article is manufactured by forming a mixture containing the metallic carrier and the tracer; and molding or casting the mixture. The degradation of the article is monitored by disposing the article downhole; degrading the article; releasing the tracer from the article to a wellbore fluid; and analyzing the wellbore fluid to determine an amount of the tracer in the wellbore fluid.

18 Claims, 2 Drawing Sheets

(56) References Cited

U.S. PATENT DOCUMENTS

| | | | | |
|---|---|---|---|---|
| 2020/0049000 | A1 | 2/2020 | Sherman et al. | |
| 2020/0255721 | A1* | 8/2020 | Planells | C09K 8/035 |

OTHER PUBLICATIONS

Murugesan, et al., "Unconventional Nanotechnology-Based Tracers for Drilling and Completion Applications"; International Petroleum Technology Conference; Jan. 13, 2020; 15 pages.

International Search Report for International Application No. PCT/US2023/014474, International Filing Date Mar. 3, 2023, Date of Mailing Jun. 29, 2023, 3 pages.

Written Opinion for International Application No. PCT/US2023/014474, International Filing Date Mar. 3, 2023, Date of Mailing Jun. 29, 2023, 5 pages.

* cited by examiner

TRACER-EMBEDDED DEGRADABLE ARTICLES, METHOD OF MANUFACTURE, AND USE THEREOF FOR DOWNHOLE APPLICATIONS

CROSS-REFERENCE TO RELATED APPLICATION

The instant application claims priority to U.S. Provisional Application No. 63/316,126, filed on Mar. 3, 2022, the content of which is incorporated herein by reference in its entirety.

BACKGROUND

Downhole degradable articles such as drop objects, frac plugs, anchors, and other tools may require a limited useful life, and it would be beneficial to have them disappear after that use is complete. Knowing how the articles are performing may provide advantages in enhancing productivity of a downhole system whether that be in hydrocarbon production or fluid sequestration efforts. Currently, it is difficult to appreciate the performance of a degradable article, during use. Accordingly the industry is receptive to new degradable articles and methods for monitoring online/inline performance of these degradable articles.

SUMMARY

A tracer-embedded degradable article comprises: a degradable metallic carrier; and a tracer disposed in the degradable metallic carrier, wherein the tracer comprises an upconverting particle that has a host material, and a dopant.

A method of manufacturing the tracer-embedded degradable article comprises: forming a mixture comprising the metallic carrier and the tracer; and molding or casting the mixture to form the tracer-embedded degradable article.

A method of monitoring a degradation of the tracer-embedded degradable article comprises: disposing the tracer-embedded degradable article downhole; degrading the tracer-embedded degradable article; releasing the tracer from the tracer-embedded degradable article to a wellbore fluid; and analyzing the wellbore fluid to determine an amount of the tracer in the wellbore fluid.

A method of analyzing water in a fluid produced from at least one zone of a well comprises introducing the tracer-embedded degradable article into the well; obtaining a sample of the fluid produced from at least one zone of the well; and analyzing the tracer in the sample.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
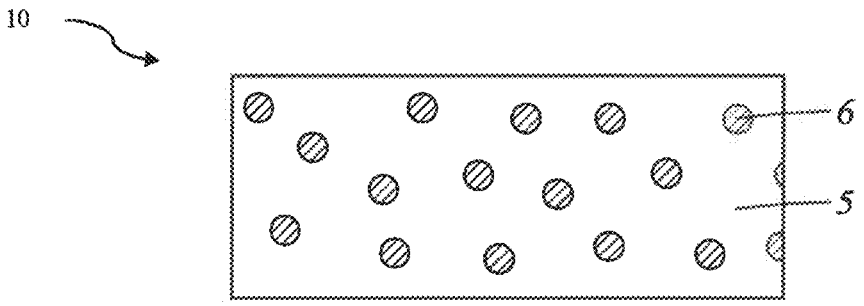
FIG. 1 is a schematic illustration of an embodiment of a tracer-embedded degradable article.

The disclosure provides a tracer-embedded degradable article whose performance can be readily monitored during use. The article has a unique combination of a particular tracer and a degradable metallic carrier. Certain tracers such as polymer based tracers cannot survive the high temperature required to make metallic based degradable articles, and it can be challenging to incorporate such tracers into metallic based articles. Advantageously, the tracer in the article described herein comprises an upconverting particle as a tracer, and the upconverting particle is stable at temperatures up to about 650° F., up to about 600° F., up to about 550° F. or up to about 500° F. depending on the application and the specific tracer used. Thus the upconverting particle can be incorporated into a high temperature process of making an article having a degradable metallic carrier. As the upconverting particle can be blended with at least a partially melt metallic carrier, and/or molded together with the metallic carrier, the upconverting particle can also be disposed uniformly throughout the degradable article.

During use, the tracer-embedded article degrades in the presence of certain downhole fluids and releases the upconverting particle. Some known tracers are not detectable in the fluids that degrade the metallic article. For example, the background noise generated by the fluids that degrade the article may mask the signals of certain tracers, thus such tracers, even if incorporated into a degradable article, cannot provide useful information about the performance of the article. The upconverting particle, on the other hand, has low energy excitation around 980 nm with high-energy emissions in the region of 200 to 950 nm. In particular, the signals from the upconverting particle are readily distinguishable from the signals generated from those organic or inorganic molecules that are present in the wellbore fluids that degrade the metallic article during various operations, thus minimizing the background noise and providing reliable information for article monitoring.

Moreover, as the unconverting particle can be disposed uniformly throughout the degradable article, a user can identify the complete degradation profile of the article. This information allows the user to better understand, monitor, and manage the degradation thus the performance of the degradable article inline/online. The information is valuable as the degradation of an article may not be readily predicable because the properties of the downhole fluids that degrade the articles can change over time in the complex downhole environments during various wellbore operations, which in turn can dynamically change the degradation rate of the article. With the complete degradation profile available, the user has the option to initiate, slow down or accelerate the degradation of the article by changing the downhole fluid properties. The information also allows the user to initiate and/or adjust well production activities accordingly, and helps to automate and digitalize wellbore operations.

As described herein, the tracer in the degradable article can include an upconverting particle. The upconvert particle can be detected with sensitivity up to the order of part-per-billion (ppb). In an aspect, the tracer is detectable at a range of from about 0.1 ppb to about 500,000 ppm. The upconverting particle can be compatible with brines and oils and are stable at elevated temperatures for an extended period of time, thus can provide reliable information when the degradable article including the tracer can be used in various downhole applications.

The upconverting particle has a host material and a dopant. The host material of the upconverting particle is an inorganic compound having an ion of $Y^{3+}$, $La^{3+}$, $Gd^{3+}$, $Sc^{3+}$, $Ca^{2+}$, $Sr^{2+}$, $Ba^{2+}$, $Zr^{4+}$ or $Ti^{4+}$. Preferably, the host material comprises at least one of $NaYF_4$, $NaGdF_4$, $LiYF_4$, $YF_3$, $CaF_2$, $Gd_2O_3$, $LaF_3$, $Y_2O_3$, $ZrO_2$, $Y_2O_2S$, $La_2O_2S$, $Y_2BaZnO_5$, or $Gd_2BaZnO_5$.

The dopant ions play a central role by absorbing and emitting the photons. They determine, for example, the color of the emitted light. The upconverting particle can have multicolors, which is achieved by utilizing the different dopants.

The dopant ions can occupy part of the cation sites in the host lattice, and preferably the dopants and host lattice cations have a similar size. Examples of the dopants include at least one of $Er^{3+}$, $Yb^{3+}$, $Tm^{3+}$, $Ho^{3+}$, $Pr^{3+}$, $Nd^{3+}$, $Dy^{3+}$, $Ti^{2+}$, $Ni^{2+}$, $Mo^{3+}$, $Re^{4+}$, or $Os^{4+}$. Preferably, the dopant of the upconverting particle comprises at least one of $Er^{3+}$, $Yb^{3+}$, $Tm^{3+}$, or $Ho^{3+}$.

In an embodiment, the dopant ions used in the upconverting particle are the pairs erbium-ytterbium ($Er^{3+}$, $Yb^{3+}$) or thulium-ytterbium ($Tm^{3+}$, $Yb^{3+}$). In such combinations ytterbium ions are added as antennas, to absorb light at around 980 nm and transfer it to the upconverter ion. If the upconverter ion is erbium, then a characteristic green and red emission is observed, while when the upconverter ion is thulium, the emission includes near-ultraviolet, blue and red light. The dopant can comprise about 5 mol % to about 30 mol % of $Yb^{3+}$ and about 1 mol % to about 3 mol % of at least one of: $Tm^{3+}$, $Ho^{3+}$, or $Er^{3+}$, each based on the total mole of the upconverting particle.

The upconverting particle can be functionalized to include chemical functional groups to increase dispersibility, solubility, compatibility, stability and other desirable properties of the upconverting particle in water, brine, oil, as well as emulsions thereof. As used herein, "functionalized upconverting particle" includes both non-covalently functionalized upconverting particle and covalently functionalized upconverting particle. Non-covalent functionalization is based on van der Walls forces, hydrogen bonding, ionic interactions, dipole-dipole interactions, hydrophobic or $\pi$-$\pi$ interactions. Covalent functionalization means that the functional groups are covalently bonded to the upconverting particle, either directly or via an organic moiety.

One way to functionalize the upconverting particle is to grow an amorphous silica shell around the particle. The chemistry of silica is well known, and the properties of silica are very advantageous. A silica layer increases the negative charge of the surface and therefore enhances the dispersibility of the upconverting particles in polar solvents. As an example, hydrolysis reaction of monomeric tetraethyl orthosilicate (TEOS) followed by a condensation step generates a hydrophilic polymer that coats the upconverting particle. The type of functionalization (e.g., amino, thiol or carboxyl group) can be tuned by choosing an appropriate organosilane (e.g., 3-aminopropyltriethoxysilane (APTS), 3-mercaptopropyltriethoxysilane or 11-dimethylchlorosilyl undecanoyl chloride) to copolymerize with TEOS.

The upconverting particle may be coated with multilayers by consecutive adsorption of polyanions such as poly(styrene sulfonate) and polycations such as poly(allylamine hydrochloride). The thickness of the coating is controlled by adjusting the number of deposited layers.

Upconverting particle can also be coated with polyacrylic acid (PAA), polyethylene glycol (PEG), or a copolymer thereof. Depending on the methods of making, the upconverting particle can have different original ligands. The original ligand on the upconverting particle can bind the polymer by attracting their hydrophobic alkyl chains, and consequently the ligand is masked while hydrophilic segments of the copolymer bearing the selected functional groups cover the outer surface. The original ligand may be exchanged to another one. In an aspect, the upconverting particle is functionalized with at least one of citric acid, PEG diacid, dendrimer, hexanedioic acid or PEG-phosphonate, oleic acid, oleyalamine, or the like.

Nano-sized upconverting particles tend to agglomerate during the process of making the degradable article, thus may not have uniform distribution in the degradable article. A degradable article with agglomerated and non-uniform upconverting nanoparticles may not provide reliable degradable profile. Accordingly, the upconverting particle in the tracer-embedded degradable article described herein can preferably have a particle size of about 0.1 to about 500 microns, preferably about 1 to about 500 microns, or about 1 to about 100 microns, and more preferably about 1 to about 10 microns. These particles are embedded in the matrix.

The degradable metallic carrier in the tracer-embedded degradable article comprises a metallic matrix formed from a corrodible matrix material comprising at least one of zinc, magnesium, aluminum, manganese, or an alloy thereof. In an aspect, the matrix material comprises at least one of: a magnesium-based alloy; an aluminum-based alloy; or a zinc-based alloy. As used herein, the term "metal-based alloy" means a metal alloy wherein the weight percentage of the specified metal in the alloy is greater than the weight percentage of any other component of the alloy, based on the total weight of the alloy.

Magnesium-based alloys include alloys of magnesium with elements such as aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), and/or zirconium (Zr). Alloying or trace elements can be included in varying amounts to adjust the corrosion rate of the magnesium. Exemplary commercial magnesium-based alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys. Other exemplary magnesium-based alloys include MgZrZn, MgAlZn, AlCuZnMn, and AlMgZnSiMn.

Aluminum-based alloys include all alloys that have aluminum as an alloy constituent. Exemplary aluminum alloys include Al—Cu alloy, Al—Mn alloy, Al—Si alloy, Al—Mg alloy, Al—Mg—Si alloy, Al—Zn alloy, Al—Li alloy, Al—Cu—Mg—X alloy, Al—Zn—Mg—Cu—X, where X represents alloying elements including Zn, Mn, Si, Cr, Fe, Ni, Ti, V, Cu, Pb, Bi, and Zr.

Zinc-based alloys include alloys of zinc with Al, Cu, Mg, Pb, Cd, Sn, Fe, Ni, Si, or a combination of the above elements. In a specific embodiment, the metallic matrix material is a magnesium alloy.

Optionally, the degradable metallic carrier can further comprise a disintegrating agent. Examples of the disintegrating agent include at least one of: a metal; an oxide of the metal; a nitride of the metal; or a cermet of the metal; wherein the metal is at least one of nickel, tungsten metal, molybdenum, copper, iron, chromium, cobalt, or an alloy thereof. The disintegration agent can be particles, for example, particles having an average particle size of about 50 nanometers to about 250 microns, about 100 nanometers to about 50 microns, about 100 microns to about 25 microns, or about 1 to about 25 microns, or about 0.1 to about 2 microns.

The amount of the disintegrating agent can vary depending on the specific materials used and desired corrosion rate. In an aspect, the tracer-embedded degradable article comprises 0.01 to 10 wt. %, or 0.05 to 8 wt. %, or 0.1 to 6 wt. % of the disintegrating agent, based on the total weight of the degradable article. In another aspect, the weight ratio of the metallic matrix material relative to the disintegrating agent is about 99:1 to about 9:1 in the degradable article.

The disintegrating agent, which has a lower reactivity relative to the metallic matrix material, can act as a cathode, whereas the metallic matrix, made of an alloy such as magnesium-based alloy which is more reactive than the disintegrating agent, is anodic relative to the disintegrating agent. A galvanic discharge cycle (e.g., corrosion) occurs between the relatively anodic and relatively cathodic materials in the presence of an electrolyte. By adjusting the compositions of the metallic matrix material and the disintegrating agent and the amount of the disintegrating agent relative to the metallic matrix material, the corrosion rate of the degradable metallic carrier can be adjusted. In an aspect, the degradable metallic carrier has a corrosion rate of about 0.1 to about 450 mg/cm$^2$/hour, specifically about 1 to about 450 mg/cm$^2$/hour, about 1 to about 300 mg/cm$^2$/hour, or about 10 to about 200 mg/cm$^2$/hour determined in aqueous 3 wt. % KCl solution at 200° F. (93° C.).

In the tracer-embedded degradable article, the tracer can be present in an amount of about 0.001 to about 5 vol. %, preferably about 0.01 to about 1 vol. %, more preferably about 0.01 vol. to about 0.1 vol. %, based on the total volume of the tracer-embedded degradable article. Tracer can be uniformly dispersed in the degradable article. As used herein, "dispersed" means that the tracer is blended with the carrier on a micrometer size level and "dispersed" does not include doping such as adding a tracer in the atomic size level where the tracer is on the lattice sites of the carrier.

Exemplary embodiments of the degradable article is shown in FIG. 1. Referring to FIG. 1, a tracer-embedded degradable article 10 comprises a degradable metallic carrier 5; and a tracer 6 disposed in the degradable metallic carrier 5. In the illustrated embodiment, tracer 6 is uniformly distributed in the degradable metallic carrier 5 throughout the degradable article 10.

Examples of the degradable article include downhole articles such as a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plugs, a drill in stim liner plugs, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, or a liner port plug.

The tracer-embedded degradable article can be integrated into various downhole assemblies. Accordingly, a downhole assembly including the tracer-embedded degradable article is disclosed. The downhole assembly can include a tubular member and the tracer-embedded degradable article radially outwardly disposed of the tubular member. The downhole assembly can be a production well system for producing fluids from multiple production zones.

Figure 2:
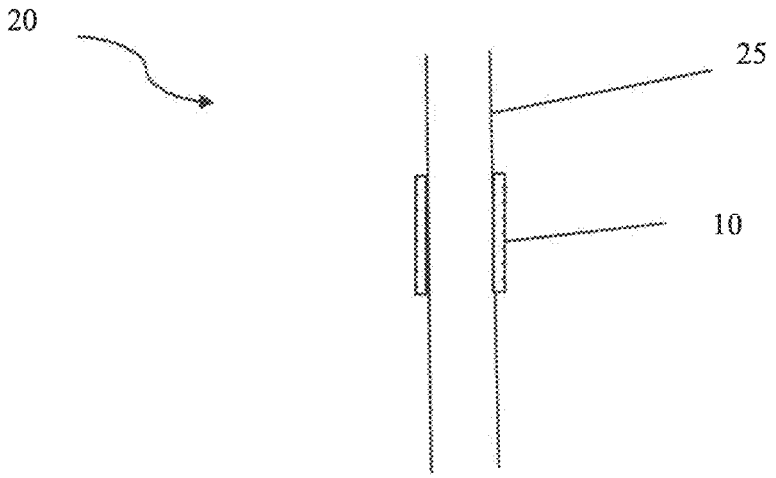
FIG. 2 is a schematic illustrate of an embodiment of a downhole assembly comprising a tracer-embedded degradable article.
Figure 3:
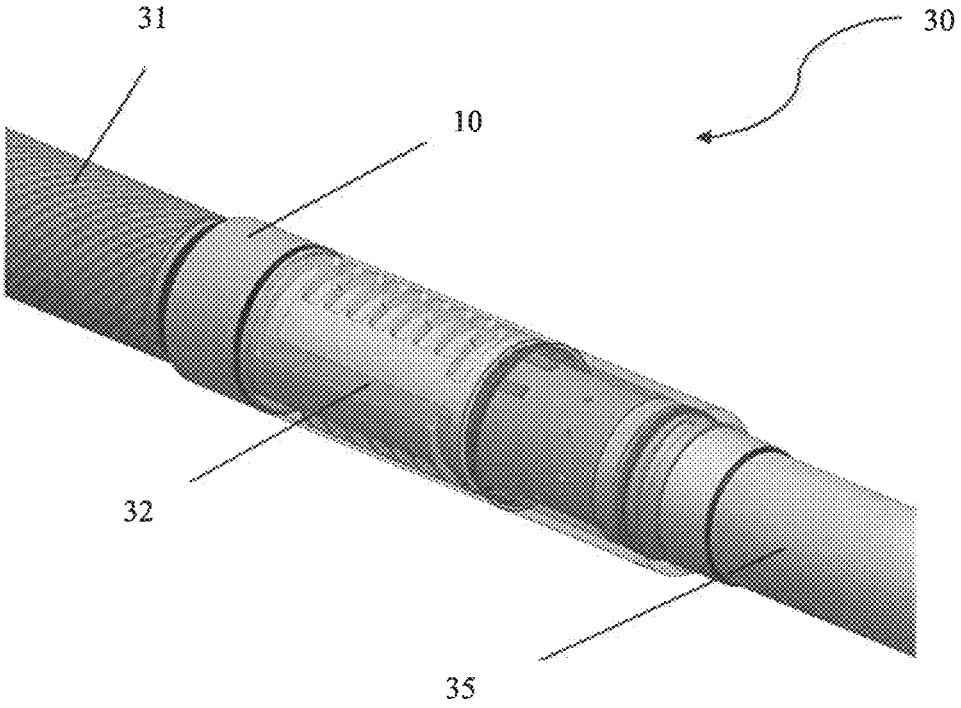
FIG. 3 is a schematic illustration of another embodiment of a downhole assembly comprising a tracer-embedded degradable article.

Referring to FIG. 2, a downhole assembly 20 includes a tubular member 25 and a tracer-embedded degradable article 10 radially outwardly disposed of the tubular member 25. Referring to FIG. 3, a downhole assembly 30 includes a pipe 35, an inflow control device 32 coupled to the pipe 35, a sand screen 31 coupled to the inflow control device 32, and a tracer-embedded degradable article 10 disposed of the inflow control device 32.

The tracer-embedded degradable article can be formed from a combination of, for example, tracers and powder constituents. The powder constituents include metallic matrix material and optionally the disintegrating agent. The powder constituents can include coated particles, uncoated particles, or a combination of coated particles and uncoated particles. The method can include compacting, sintering, forgoing such as by cold isostatic pressing (CIP), hot isostatic pressing (HIP), or dynamic forging.

One way to form the tracer-embedded degradable article includes forming a mixture comprising the metallic carrier and the tracer, and molding or casting the mixture to form the tracer-embedded degradable article.

The mixture can be formed by blending the metallic matrix material, the tracer, and the optional disintegrating agent. In an aspect, the mixture is a liquid-solid mixture, which comprises the tracer and the optional disintegrating agent in a solid form, and the metallic matrix material in a liquid form. The method can include mixing the metallic matrix material in a solid form with the tracer and the optional disintegrating agent to provide a blend; and heating the blend optionally under agitation to selectively melt the metallic matrix material. Alternatively, the solid-liquid solid mixture is made by heating the metallic matrix material in a solid form to provide a molten metallic matrix material; and introducing the disintegrating agent and the tracer to the molten matrix material under agitation. Heating the blend and heating the metallic matrix material can be conducted at a temperature above the melting point of the metallic matrix material. In an aspect, the heating is to a temperature of about 450° C. to about 850° C. The heating can be conducted at atmospheric pressure in the presence or absence of an inert atmosphere.

The homogeneous mixture can be molded or casted. The casting method is not limited and includes die casting. To mold the mixture, the mixture is first disposed in a mold. The method of disposing is not particularly limited. For example, the homogeneous mixture can be poured into the mold, pushed into the mold under a superatmospheric pressure, or drawn to the mold under a subatmospheric pressure.

The molding can be a pressure molding or a vacuum molding. For example, the molding can be conducted at a pressure of about 500 psi to about 30,000 psi or about 1000 psi to about 5000 psi. The pressure can be a superatmospheric pressure or a subatmospheric pressure. In an aspect, the mold is not heated. In another aspect, the mold is heated to a temperature of about 90° C. to about 450° C. or about 150° C. to about 350° C. Optionally during the molding, an agitation force is applied to the mixture by mechanical means, electromagnetic means, acoustic means, or a combination comprising at least one of the foregoing.

The mold product is allowed to cool down to room temperature when the mold is still under pressure. In the instance where the molded product is subjected to a subsequent extrusion operation, the molded product can be cooled to a temperature above the room temperature. An agitation force is optionally applied to the molded product during the cooling process. The cooled article can be machined or used as is.

For applications requiring higher strength, the molded article is further extruded. During extrusion, the pores inside the molded product are fully closed to provide a condensed article having high tensile strength, high shear strength, and high compression strength. In addition, the extruded product can degrade more uniformly. The extrusion temperature can be about 200° C. to about 500° C., about 250° C. to about 450° C., or about 320° C. to about 420° C.

If necessary, the obtained article can be further machined or shaped to accommodate engineering design. Machining includes cutting, sawing, ablating, milling, facing, lathing, boring, and the like using, for example, a miller, saw, lathe, router, electric discharge machine, and the like.

The degradation and performance of the article can be monitored. A method of monitoring a degradation of the tracer-embedded degradable article comprises: disposing the tracer-embedded degradable article downhole; degrading the tracer-embedded degradable article; releasing the tracer to a wellbore fluid; and analyzing the wellbore fluid to determine an amount of the tracer in the wellbore fluid.

As used herein, analyzing the wellbore fluid comprises measuring one or more optical properties of the upconverting particle. Examples of the optical properties include an absorption spectrum, an absorption intensity, a peak absorption wavelength, an emission spectrum, a peak emission wavelength, a fluorescence intensity of an upconverting particle, or a combination thereof. Methods of measuring the optical properties of an upconverting particle are known in the art and are not particularly limited.

The wellbore fluid can be recovered and transported out of the wellbore. Thus, in an aspect, the method described herein does not require downhole equipment for detection. Fluids transported out of the wellbore are evaluated, and the upconverting particle can be identified and analyzed at a location distant from the wellbore.

If needed, the upconverting particle can be analyzed within the wellbore. In an aspect, analyzing the wellbore fluid comprises exposing the wellbore fluid comprising the upconverting particle to an excitation radiation from an electromagnetic radiation source within the wellbore; and measuring an optical property of the upconverting particle in the wellbore fluid within the wellbore.

A radiation source can be located within the wellbore to provide the excitation radiation to the upconverting particle. For example, a radiation source (e.g., a light source) may be coupled to a fiber optic cable, which may transmit the excitation radiation to the upconverting particle. Responsive to exposure to the excitation radiation, the upconverting particles re-emit radiation at a different wavelength than the excitation wavelength, and the emitted radiation can be transmitted through an optical fiber to a detector to measure the desired optical properties of the upconverting particle.

The tracer-embedded degradable article can also be used to analyze water in a fluid produced from at least one zone of a well. In particular, the metallic carrier in the tracer-embedded article is stable in the presence of hydrocarbons but can degrade in the presence of water. Accordingly, when the tracer-embedded degradable article is in contact with a wellbore fluid containing water, the metallic carrier degrades, releasing the tracer as a function of the concentration of water. Thus, water cut can be determined by analyzing the tracer in the wellbore fluid containing the tracer.

A method of analyzing water in a fluid produced from at least one zone of a well includes: introducing the trace-embedded article into the well; obtaining a sample of the fluid produced from at least one zone of the well; and analyzing the tracer in the sample. Once the tracer concentration has been determined, the information may be used in a variety of ways. For example, the concentration of detected tracer can provide information of the flow rate of produced water and/or the water cut in the produced fluid.

Downhole water production detection and quantitative analysis method disclosed herein can be used for single zone or multiple zones for conventional oil and gas, deepwater, unconventional oil and gas, and stream-assisted gravity drainage applications.

In use, the tracer-embedded degradable article can be installed in a production well system for producing fluids from at least one production zone. In an aspect, multiple tracer-embedded degradable articles are used in a well having multiple production zones, where the tracer-embedded degradable article used can be unique for each zone. For example, the degradable article for each zone can include an upconverting particles exhibiting different optical properties to determine a location (e.g., a zone) from which produced fluids (e.g., hydrocarbons, water, etc.) originate, and based on the amount of measured tracers the amount of water flowing into the well at each zone can be calculated. In other words, the degradable articles in different zones have upconverting particles that are qualitatively (and optionally also quantitatively) distinguishable. For example, the degradable articles introduced into each of the zones can contain upconverting particles preferably exhibiting unique absorption and optical properties such that the properties of upconverting particles introduced into one zone is unable to mask the properties of upconverting particles introduced into another zone. Thus, a produced fluid exhibiting an optical property corresponding to a property of an upconverting particle introduced into a zone of the subterranean zone may be an indication that the produced fluid originated from the zone in which the upconverting particle were introduced in the degradable article.

Advantageously, the degradable articles introduced into different zones contain upconverting particles emitting a different color of light when exposed to the same excitation radiation having a monochromatic wavelength. In an embodiment, the monochromatic wavelength is about 980 nanometers (nm). Thus different types of the upconverting nanoparticles can be conveniently detected with the same excitation radiation.

Set forth are various aspects of the disclosure.

Aspect 1. A tracer-embedded degradable article comprising: a degradable metallic carrier; and a tracer disposed in the degradable metallic carrier, wherein the tracer comprises an upconverting particle that has a host material, and a dopant.

Aspect 2. The tracer-embedded degradable article as in any prior aspect, wherein the tracer is disposed uniformly throughout the metallic carrier.

Aspect 3. The tracer-embedded degradable article as in any prior aspect, wherein the upconverting particle has a particle size of about 0.1 micron to about 500 microns.

Aspect 4. The tracer-embedded degradable article as in any prior aspect, wherein the tracer is present in an amount of about 0.001 to about 5 volume percent, based on a total volume of the tracer-embedded degradable article.

Aspect 5. The tracer-embedded degradable article as in any prior aspect, wherein the host material of the upconverting particle comprises at least one of $NaYF_4$, $NaGdF_4$, $LiYF_4$, $YF_3$, $CaF_2$, $Gd_2O_3$, $LaF_3$, $Y_2O_3$, $ZrO_2$, $Y_2O_2S$, $La_2O_2S$, $Y_2BaZnO_5$, or $Gd_2BaZnO_5$, and the dopant of the upconverting particle comprises at least one of $Er^{3+}$, $Yb^{3+}$, $Tm^{3+}$, or $Ho^{3+}$.

Aspect 6. The tracer-embedded degradable article as in any prior aspect, wherein the upconverting particle is functionalized with at least one of citric acid, a polyethylene glycol diacid, a dendrimer, hexanedioic acid, a polyethylene glycol-phosphonate, oleic acid, or oleyalamine.

Aspect 7. The tracer-embedded degradable article as in any prior aspect, wherein the degradable metallic carrier has a corrosion rate of about 0.1 to about 450 mg/cm$^2$/hour, determined in aqueous 3 wt. % KCl solution at 200° F. (93° C.).

Aspect 8. The tracer-embedded degradable article as in any prior aspect, wherein the metallic carrier comprises a metallic matrix comprising at least one of zinc, magnesium, aluminum, manganese, or an alloy thereof.

Aspect 9. The tracer-embedded degradable article as in any prior aspect, wherein the degradable metallic carrier further comprises a disintegrating agent, which comprises at least one of: a metal, an oxide of the metal, a nitride of the metal, or a cermet of the metal; wherein the metal is at least one of nickel, tungsten metal, molybdenum, copper, iron, chromium, cobalt, or an alloy thereof.

Aspect 10. The tracer-embedded degradable article as in any prior aspect, wherein the metallic matrix and the disintegrating agent form a plurality of galvanic cells.

Aspect 11. A downhole assembly comprising the tracer-embedded degradable article as in any prior aspect.

Aspect 12. The downhole assembly of Aspect 11, further comprising a tubular member, and the tracer-embedded degradable article is radially outwardly disposed of the tubular member.

Aspect 13. A method of manufacturing the tracer-embedded degradable article as in any prior aspect, the method comprising: forming a mixture comprising the metallic carrier and the tracer; and molding or casting the mixture to form the tracer-embedded degradable article.

Aspect 14. The method of Aspect 13, wherein the mixture is a solid-liquid mixture comprising the tracer and a disintegrating agent in a solid form and a metallic matrix material in a liquid form.

Aspect 15. A method of monitoring a degradation of the tracer-embedded degradable article as in any prior aspect, the method comprising: disposing the tracer-embedded degradable article downhole; degrading the tracer-embedded degradable article; releasing the tracer from the tracer-embedded degradable article to a wellbore fluid; and analyzing the wellbore fluid to determine an amount of the tracer in the wellbore fluid.

Aspect 16. A method of analyzing water in a fluid produced from at least one zone of a well, the method comprising: introducing the tracer-embedded degradable article as in any prior aspect into the well; obtaining a sample of the fluid produced from at least one zone of the well; and analyzing the tracer in the sample.

Aspect 17. The method as in any prior aspect, wherein analyzing the tracer comprises determining the concentration of the tracer by measuring an optical property of the upconverting particle, and measuring the optical property of the upconverting particle comprises measuring adsorption spectrum, an emission spectrum, an absorption intensity, a peak absorption wavelength, a peak emission wavelength, an emission intensity of the upconverting nanoparticle, or a combination comprising at least one of the foregoing.

Aspect 18. The method as in any prior aspect, wherein separate articles are located at different zones of the well.

Aspect 19. The method as in any prior aspect, wherein the method further comprises determining the flow rate of water in the produced fluid or determining a content of water in the produced fluid.

As used herein, the size or average size of the particles refers to the largest dimension of the particles and can be determined by high resolution electron or atomic force microscope technology. Average particle size refers to number average particle size.

All ranges disclosed herein are inclusive of the endpoints, and the endpoints are independently combinable with each other. "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like. "A combination thereof" means "a combination comprising one or more of the listed items and optionally a like item not listed." All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

What is claimed is:

1. A tracer-embedded degradable article comprising:
a degradable metallic carrier; and
a tracer disposed in the degradable metallic carrier,
wherein the tracer comprises an upconverting particle that has a host material, and a dopant,
the upconverting particle has a particle size of about 0.1 micron to about 500 microns, and
the tracer is disposed uniformly throughout the metallic carrier.

2. The tracer-embedded degradable article of claim 1, wherein the upconverting particle has a particle size of about 1 micron to about 500 microns.

3. The tracer-embedded degradable article of claim 1, wherein the tracer is present in an amount of about 0.001 to about 5 volume percent, based on a total volume of the tracer-embedded degradable article.

4. The tracer-embedded degradable article of claim 1, wherein the host material of the upconverting particle comprises at least one of $NaYF_4$, $NaGdF_4$, $LiYF_4$, $YF_3$, $CaF_2$, $Gd_2O_3$, $LaF_3$, $Y_2O_3$, $ZrO_2$, $Y_2O_2S$, $La_2O_2S$, $Y_2BaZnO_5$, or $Gd_2BaZnO_5$, and the dopant of the upconverting particle comprises at least one of $Er^{3+}$, $Yb^{3+}$, $Tm^{3+}$, or $Ho^{3+}$.

5. The tracer-embedded degradable article of claim 1, wherein the upconverting particle is functionalized with at least one of citric acid, a polyethylene glycol diacid, a dendrimer, hexanedioic acid, a polyethylene glycol-phosphonate, oleic acid, or oleyalamine.

6. The tracer-embedded degradable article of claim 1, wherein the degradable metallic carrier has a corrosion rate of about 0.1 to about 450 mg/cm$^2$/hour, determined in aqueous 3 wt. % KCl solution at 200° F. (93° C.).

7. The tracer-embedded degradable article of claim 1, wherein the metallic carrier comprises a metallic matrix comprising at least one of zinc, magnesium, aluminum, manganese, or an alloy thereof.

8. The tracer-embedded degradable article of claim 7, wherein the degradable metallic carrier further comprises a disintegrating agent, which comprises at least one of: a metal, an oxide of the metal, a nitride of the metal, or a cermet of the metal; wherein the metal is at least one of nickel, tungsten metal, molybdenum, copper, iron, chromium, cobalt, or an alloy thereof.

9. The tracer-embedded degradable article of claim 8, wherein the metallic matrix and the disintegrating agent form a plurality of galvanic cells.

10. A downhole assembly comprising the tracer-embedded degradable article of claim 1.

11. The downhole assembly of claim 10, further comprising a tubular member, and the tracer-embedded degradable article is radially outwardly disposed of the tubular member.

12. A method of manufacturing the tracer-embedded degradable article of claim 1, the method comprising:

forming a mixture comprising the metallic carrier and the tracer; and molding or casting the mixture to form the tracer-embedded degradable article.

13. The method of claim 12, wherein the mixture is a solid-liquid mixture comprising the tracer and a disintegrating agent in a solid form and a metallic matrix material in a liquid form.

14. A method of monitoring a degradation of the tracer-embedded degradable article of claim 1, the method comprising:

disposing the tracer-embedded degradable article downhole;

degrading the tracer-embedded degradable article;

releasing the tracer from the tracer-embedded degradable article to a wellbore fluid; and analyzing the wellbore fluid to determine an amount of the tracer in the wellbore fluid.

15. A method of analyzing water in a fluid produced from at least one zone of a well, the method comprising:

introducing the tracer-embedded degradable article of claim 1 into the well;

obtaining a sample of the fluid produced from at least one zone of the well; and analyzing the tracer in the sample.

16. The method of claim 15, wherein analyzing the tracer comprises determining the concentration of the tracer by measuring an optical property of the upconverting particle, and measuring the optical property of the upconverting particle comprises measuring adsorption spectrum, an emission spectrum, an absorption intensity, a peak absorption wavelength, a peak emission wavelength, an emission intensity of the upconverting nanoparticle, or a combination comprising at least one of the foregoing.

17. The method of claim 15, wherein separate articles are located at different zones of the well.

18. The method of claim 15, wherein the method further comprises determining the flow rate of water in the produced fluid or determining a content of water in the produced fluid.

* * * * *